United States Patent [19]

Hennemann

[11] 3,947,791

[45] Mar. 30, 1976

[54] LOCKING DEVICE HAVING LOW CONTROL POWER FOR AN ELECTRICAL DEVICE

[75] Inventor: Jean Hennemann, Hombliéres, France

[73] Assignee: UNELEC, Cedex, France

[22] Filed: Jan. 13, 1975

[21] Appl. No.: 540,463

[30] Foreign Application Priority Data

Jan. 22, 1974 France ..... 74.02091

[52] U.S. Cl. ..... 335/167; 200/320; 335/172

[51] Int. Cl.[2] ..... H01H 73/02

[58] Field of Search ..... 335/167, 168, 169, 170, 335/171, 172, 173, 174, 175; 200/320

[56] References Cited

UNITED STATES PATENTS 3,748,609 7/1973 Wallace et al. ..... 335/174

3,808,567 4/1974 Maier ..... 335/167

*Primary Examiner*—Harold Broome

*Attorney, Agent, or Firm*—Sughrue, Rothwell, Mion, Zinn & Macpeak

[57] ABSTRACT

Locking device of low control power for an electrical device having, between the locked part and the locking control element, a locking assembly having a rolling movement. This locking assembly has a rotating bearing and at least one coaxial disk is installed floating in a yoke connected with the control element. The device is installed more particularly on circuit-breakers for which it ensures accurate controlling, low consumption of power and high reliability.

8 Claims, 4 Drawing Figures

LOCKING DEVICE HAVING LOW CONTROL POWER FOR AN ELECTRICAL DEVICE

BACKGROUND OF THE INVENTION

1. Field of the Invention

The present invention concerns a locking device having low control power for an electrical device and comprising, between a locked part and a control element for the locking operation, a locking assembly and relates more particularly to the measurements to be taken both at the level of the structure of the said device and at the level of the kinetic drive chain intended for ensuring the accuracy of its operation with the required speed and the saving of power consumed by the manoeuvring of the said control element.

2. Description of the Prior Art

It is already known, at the level of the locking contacts, to replace the sliding friction by the very slight rolling friction, using parts having a relative rolling movement. It is more particularly known to arrange, as an assembly locking two superimposed rolling elements between which is inserted and pressed together by the locking force, a rod used for controlling the locking operation. Moreover, the fact of subjecting the control rod to the total locking effort, entails, more particularly, the difficulty of obtaining an accurate positioning of the parts subjected to a great stress. Moreover, the necessary guiding of the control rod having a linear movement induces spurious efforts which may be great if the system is badly balanced or on account of an inaccurate positioning.

SUMMARY OF THE INVENTION

The object of the present invention is to obviate such a disadvantage by the use of a locking assembly comprised between the intermediate locked part and the locking control element. That locking assembly is formed by a rotating bearing and at least one coaxial disk respectively in rolling contact at its periphery with the said intermediate locked part and with a support surface; whereas the said assembly is installed floating at one of the ends of the said control element.

The aim and the other characteristics of the invention will become apparent from the example of embodiment, having no limiting character and in connection with the drawings.

DESCRIPTION OF THE PREFERRED EMBODIMENT

Figure 1:
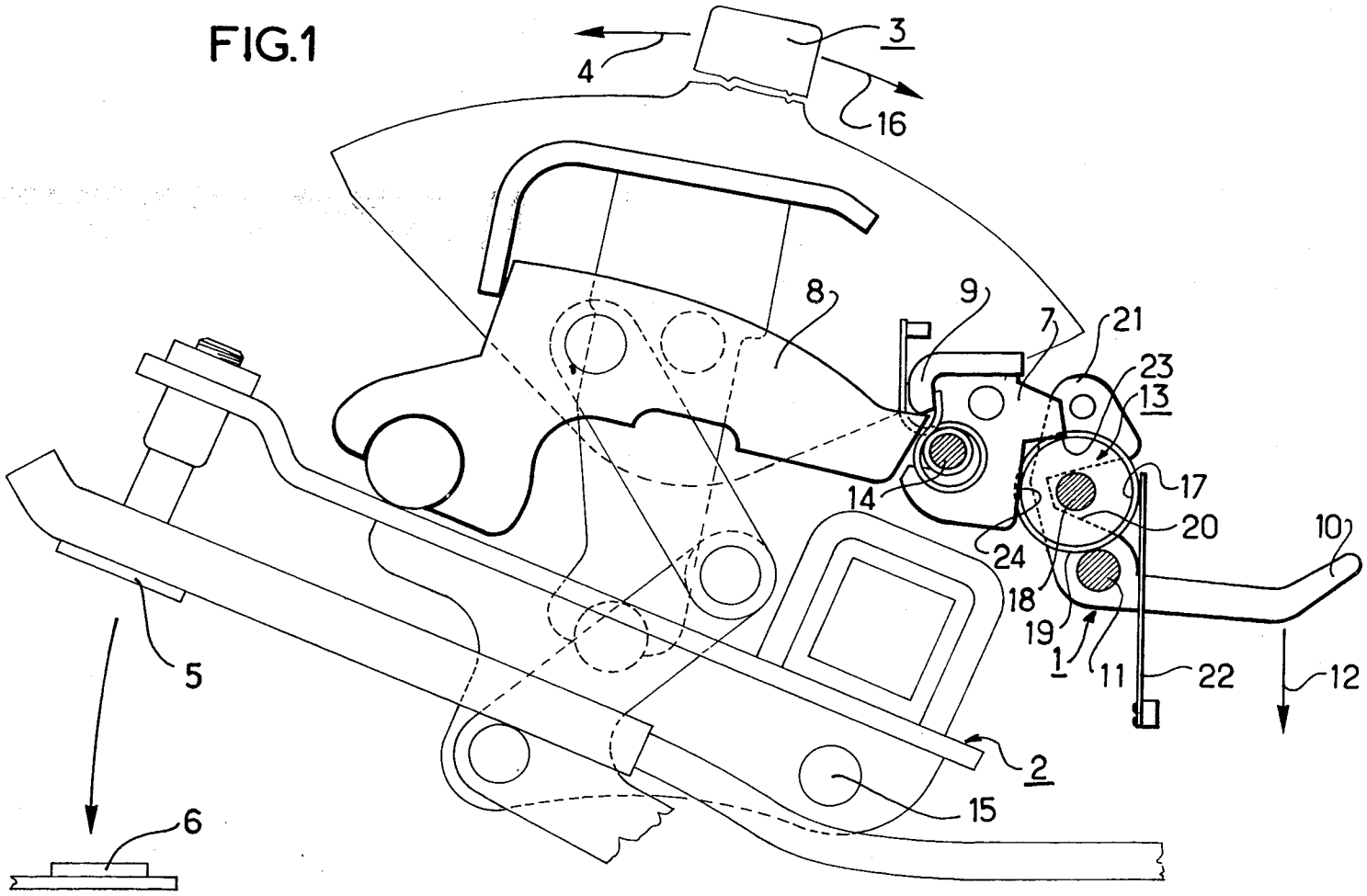
FIG. 1 shows the locking device according to the invention connected up to a circuit-breaker.

In FIG. 1, the locking device 1 is connected up to the circuit-breaker 2 provided with a tilting handle 3 enabling, by its movement in the direction of the arrow 4, the closing of the mobile contact 5 on the fixed contact 6 of the circuit-breaker 2.

The intermediate or bolt 7 locked by the locking device 1 acts as a bolt for the part 8 in the control mechanism for the circuit-breaker 2, by means of the cleat 9 which it bears.

The locking device 1 is used for the automatic opening of the circuit-breaker by action on the control lever 10 rotating about its axis 11 under the effect of a force directed along the arrow 12, so that the locking assembly 13 releases the intermediate part 7 whose rotation about axle 14 releases, in its turn, the mechanism of the circuit-breaker 2 and ensures the separating of the contacts 5 and 6, the part bearing the contact 5 rotating about axis 15. This assumes, of course, that before the manual closing by means of the tilting handle 3, the tripping of the mechansim is effected by moving the handle 3 in the direction of the arrow 16.

The locking assembly 13 itself comprises a bearing 17 rotating about an axle 18 and comprised between two coaxial disks 19 installed on the axle 18 and in rolling contact at their periphery with the fixed axle 11. The axle 18 is installed floating in the hollowed parts or slots 20 of the yoke 21 forming one of the ends of the control lever 10; whereas a fixed spring 22 permanently presses on the disks 19 with an effort which is very slight but sufficient for keeping the locking assembly 13 in position.

In the locking position, the bearing 17 is in contact at its periphery at two points 23 and 24 with the locked intermediate part 7, ensuring, respectively, the locking contact and the position of the locking assembly 13; whereas the disks 19 bear against the axle 11.

Figure 2A:
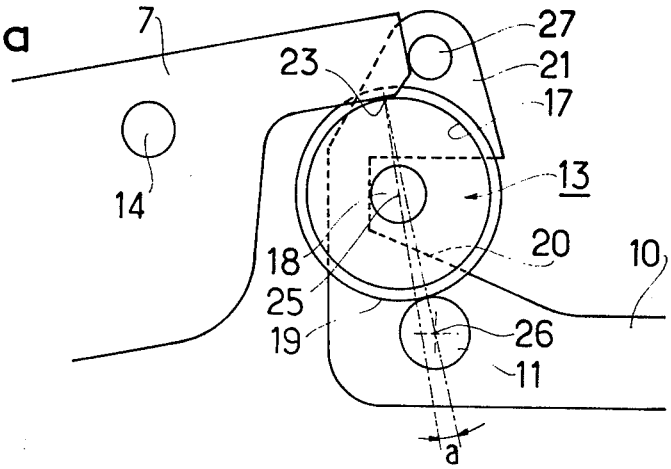
FIGs. 2*a*, 2*b* and 2*c* show the locking device in the respective positions: before, during and after unlocking.
Figure 2B:
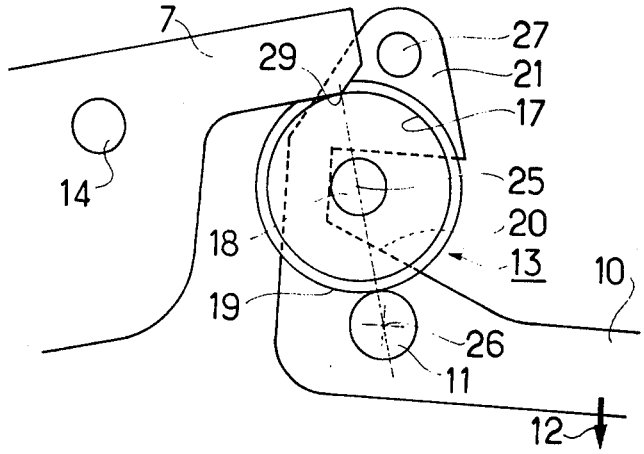
Figure 2C:
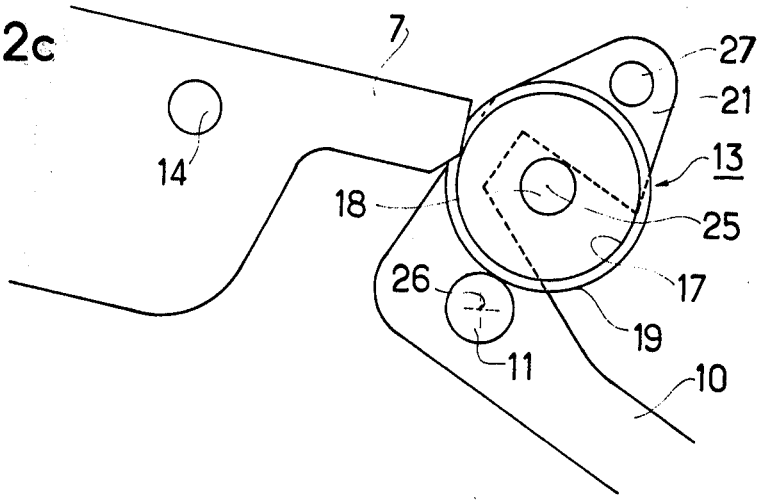

In FIGS. 2*a*, 2*b*, 2*c*, the parts fulfilling the same functions have the same reference numerals as those corresponding to them in FIG. 1 assigned to them. Moreover, the pressure spring 22 of the locking assembly 13 is not shown.

In FIG. 2*a*, the intermediate part 7 is locked and its point of contact 23 with the locking assembly 13 is such that the extension of the line perpendicular to the periphery of the bearing 17 at the said point 23 and passing through the point 25, which is the axis of symmetry of the shaft 18, be offset but near to the axis of symmetry 26 of the fixed axle 11 and on the same side as the part 7; in this way, on the one hand, the point 25 is on the same side as the part 7 with respect to the straight line connecting together the points 23 and 26 and the angle *a* formed by the straight lines 23, 25 and 23, 26 is very small. The stop 27, fixed on the yoke 21, determines, by its contact with the part 7, the position of the locking assembly 13 when it fulfills the locking function.

In FIG. 2*b*, by actuating the control lever in the direction of the arrow 12, the locking device has been set in motion, the contact of the stop 27 with the part 7 has ceased and the locking contact point of the part 7 by the assembly 13 has reached point 29, so that the three points 29, 25 and 26 are alined.

To make the locking device pass from the position in FIG. 2*a* to that in FIG. 2*b*, it was necessary to exert an effort on the locking assembly 13. Designating as F the locking force, that is, the force exerted at 23 by the part 7 on the assembly 13 in the direction of the straight line 23, 25 and neglecting the rolling friction forces exerted on the assembly 13 both at the point 23 and at the contact points of the disks 19 with the fixed axle 11, it may be admitted that the force applied at 25, perpendicularly to the straight line 23, 25 is proportional to the product F*a*, the smallness of the angle *a* allowing the merging of the sine and the arc: this is the force which should be overcome to effect the unlocking and the elementary work being proportional to F*a da*, *da* representing the elementary variation of the angle, the power to be provided for passing from the position in FIG. 2*a*, in which the original angle is *a*, to that in 2*b*, in which the final angle is zero, is proportional to *a*2 and consequently very small.

To pass from the position in FIG. 2*b* to that in 2*c*, no effort is needed, for the tangential force exerted on the point 25 has changed direction after having been cancelled and then, the spring of the mechanism of the circuit-breaker 2 provides the movement power of the device.

Figure 3:
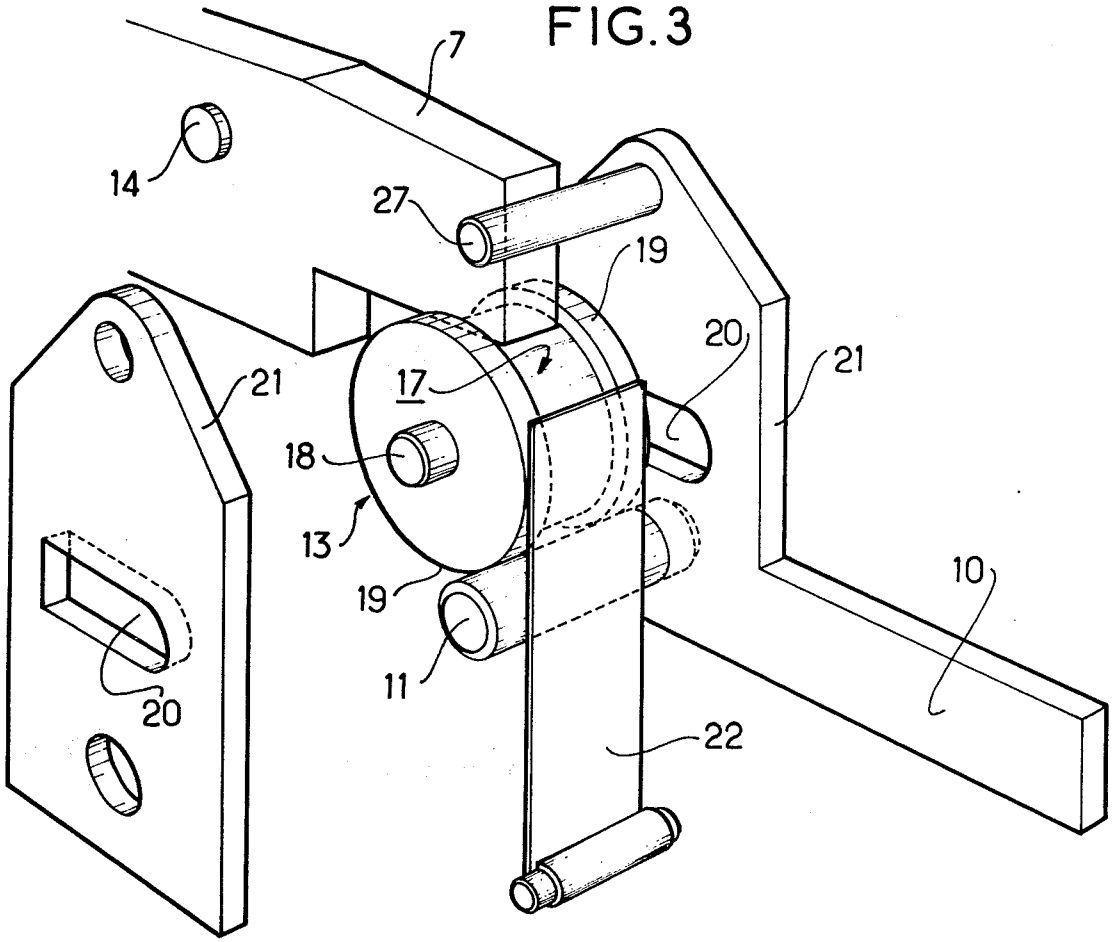
FIG. 3 is an exploded perspective view of the locking assembly according to FIG. 2.

In FIG. 3, the spring 22 bears against the disks 19 to keep the locking assembly 13 in position in the hollowed parts or slots 20 of the yoke 21 in which the ends of the shaft 18 supporting the rotating bearing 17 revolve. Moreover, that spring 22 automatically ensures the return to the locking position such as shown in FIG. 2*a* of the locking assembly 13 and of the control lever 10 at the time of the circuit-breaker tripping operation, an operation which has the effect of bringing the locked part 7 into its original-position as in FIG. 2*a*. That automatic return can be effected only if the action on the control lever 10, in the direction of the arrow 12 has ceased. In the contrary case, it is then impossible to trip the locking mechanism and hence to close the circuit-breaker.

Figure 4:
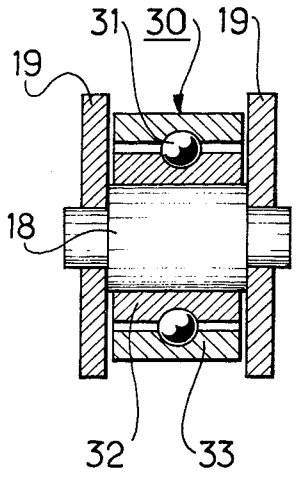
FIG. 4 shows an axial cross-section view of the locking assembly according to the invention.

In FIG. 4, the rotating bearing is a ball bearing 30 with balls 31, whose internal cage 32 is force fitted on the shaft 18 whereas the external cage 33 acts as a bearing surface for the part 7 (FIG. 3). The disks 19 are fitted onto the shaft 18 so that during the operations, only the rolling forces of the disks 19 on the fixed axle 11 are brought into play.

This device, due to the use of rolling friction forces, cancels the uncertainties concerning their values, this giving rise to the double advantage of the accuracy of the position of the device in the locking state and of the precision of its operation based on that state.

Moreover, taking into account the reduction of the forces to be brought into play, the device has a lighter structure, slighter wear and hence greater reliability and speed of operation than those in known devices.

It is self-evident that the description of these few variants has no exhaustive character, but that the protection sought by the present application comprises all the variants corresponding to the general definition which has been given thereof and more particularly those using equivalent means to those described and within the understanding of the man in the art.

I claim:

1. Locking device having a low control power for locking an electrical device including a lockable part, said control device comprising: a locking control element, a locking assembly operatively positioned between said lockable part and said locking control element and responsive to movement of the locking control element to release said lockable part; the improvement wherein: a bolt is operatively positioned between said locking assembly and said lockable part for selectively locking and unlocking said lockable part and in turn being selectively locked by said assembly, and wherein said assembly comprises a rotating bearing and at least one coaxial disk, said bearing and said disk respectively being in rolling contact at their periphery with said bolt and with a fixed bearing surface and wherein said bearing assembly is floatingly mounted on said control element.

2. The locking device as claimed in claim 1, wherein said rotating bearing comprises a shaft mounted for rotation within slots provided within a yoke connected to a lever and constituting said control element, a pair of coaxial disks fixed to said shaft, a ball bearing is provided between said disks including an external cage whose diameter is smaller than that of said coaxial disks and having an internal cage interposed between said disks internally of said external cage and in contact with said shaft.

3. Locking device having low control power for an electrical device according to claim 1, wherein: the bearing surface is a fixed cylindrical axle.

4. Locking device having low control power for an electrical device according to claim 3, wherein: the control element is installed to rotate on the fixed cylindrical axle.

5. The locking device having low control power for an electrical device according to claim 4, wherein: a spring biases the locking assembly in position in the yoke and ensures an automatic return of the locking assembly and of the control element to the position corresponding to the locking when the bolt is brought back to that same position.

6. The locking device having low control power for an electrical device according to claim 1, wherein: at the end of the locking movement, an auxiliary support means ensures, for the axle of the locking assembly a position near to the line joining the locking contact to the cylindrical support axle and situated, in relation thereto on the same side as the bolt.

7. The locking device having low control power for an electrical device according to claim 6, wherein: a stop installed near the end of the yoke of the control element forms an auxiliary bearing means co-operating with the front end of the bolt.

8. The locking device having low control power for an electrical device according to claim 6, wherein: the rotating bearing of the locking assembly forms a support means by making a second contact with the bolt.

* * * * *